US006029826A

United States Patent [19]

Clay

[11] Patent Number: 6,029,826

[45] Date of Patent: Feb. 29, 2000

[54] ROTATABLE AND RELEASABLE SPORTS BALL DISPLAY MECHANISM

[76] Inventor: Timothy H. Clay, 9625 Bark Chip Way, Douglasville, Ga. 30135

[21] Appl. No.: 09/291,741

[22] Filed: Apr. 14, 1999

[51] Int. Cl.[7] ..... A47F 7/00

[52] U.S. Cl. ..... 211/14; 211/85.7; 206/315.9; 248/176.1; 248/205.2; D6/552

[58] Field of Search ..... 211/14, 85.7; 248/176.1, 248/316.1, 205.2, 127; 40/493, 327; 206/315.9; D6/552

[56] References Cited

U.S. PATENT DOCUMENTS

| | | | |
|---|---|---|---|
| 1,124,896 | 1/1915 | Hartman . | |
| 2,368,347 | 1/1945 | Colberg . | |
| 3,231,993 | 2/1966 | Levy . | |
| 3,281,961 | 11/1966 | Tiddens . | |
| 3,559,935 | 2/1971 | Gardner | 211/14 X |
| 4,938,695 | 7/1990 | Kinner . | |
| 4,955,485 | 9/1990 | Alton . | |
| 5,165,538 | 11/1992 | Peters | 211/14 X |
| 5,377,829 | 1/1995 | Bahl . | |
| 5,580,253 | 12/1996 | Abdalla . | |
| 5,695,056 | 12/1997 | Bender et al. | 211/14 X |
| 5,848,790 | 12/1998 | Lee | 248/316.1 X |
| 5,868,249 | 2/1999 | Ehnert | 206/315.9 |

*Primary Examiner*—Robert W. Gibson, Jr.
*Attorney, Agent, or Firm*—William B. Noll

[57] ABSTRACT

A rotatable sports ball display mechanism that utilizes a pair of pressure applying, aligned adjustment members, secured to a C-configured bracket, and mounting hook and pile type fastening members. By the use of such fastening members, only limited pressure is needed to rotatably secure a sports ball to the bracket.

6 Claims, 1 Drawing Sheet

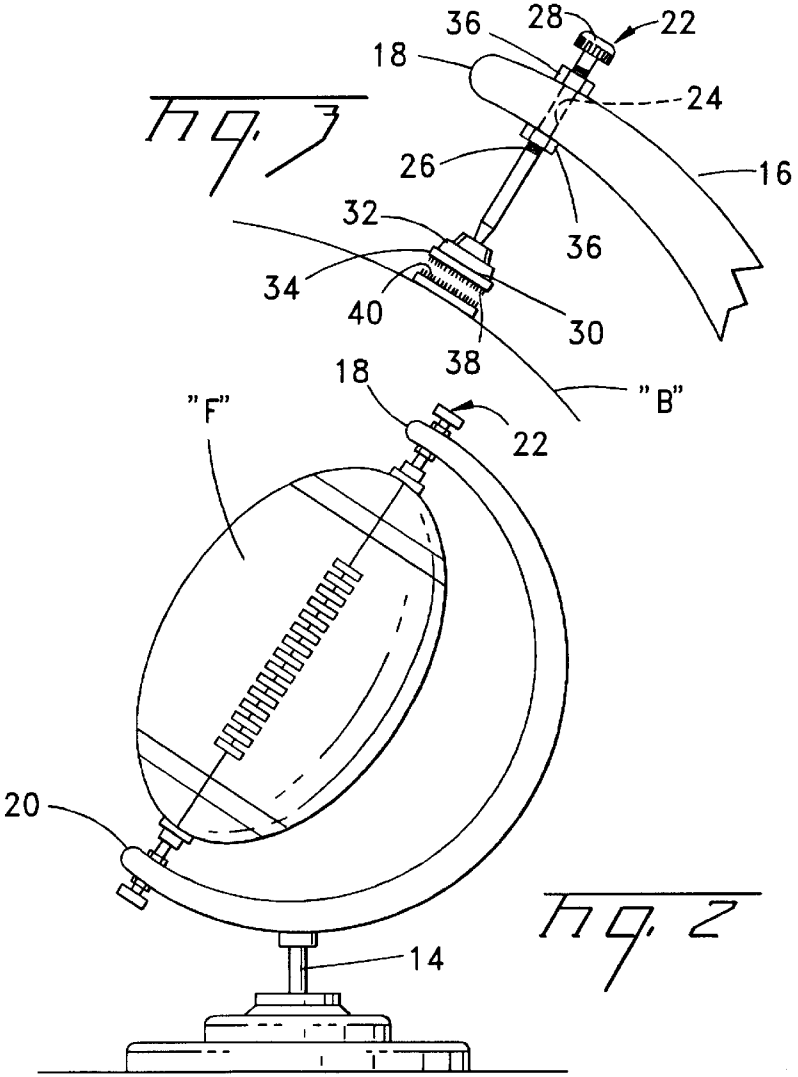
Fig. 3
Fig. 2
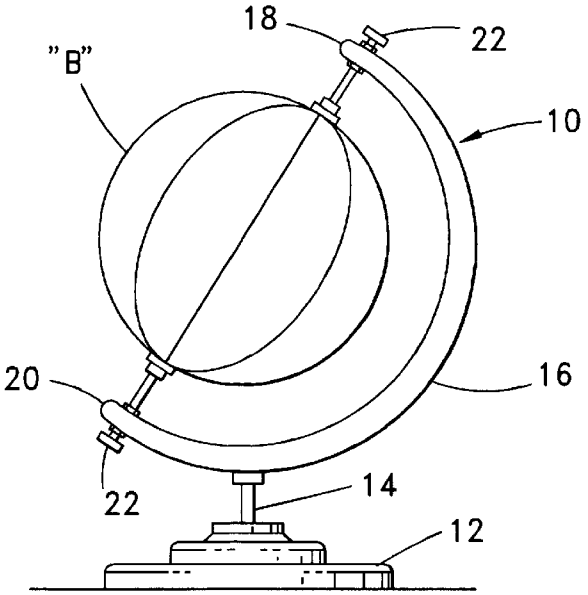
Fig. 1

ROTATABLE AND RELEASABLE SPORTS BALL DISPLAY MECHANISM

FIELD OF THE INVENTION

This invention is directed to the field of sports memorabilia display devices, more particularly a sports ball, such as a football or basketball.

BACKGROUND OF THE INVENTION

The present invention relates to a sports ball display mechanism, such as for conventional footballs and basketballs, where the mechanism is intended to allow fill viewing of the sports ball, and for its easy removal for handling and sharing. Too often, typical display devices for sports balls are static displays which allow for limited angle viewing and/or no simple means for handling the sports ball. There are several of these static display devices as reflected in the following U.S. Patents:

a.) U.S. Pat. No. 5,377,829 to Bahl, teaches a football display case comprising a base in a rectangular configuration having an upper surface and a lower surface, the base being sanded, stained and finished with polyurethane; a piece of plywood in a rectangular configuration having an upper and lower surface and glued at its lower surface to the upper surface of the base; a piece of artifical turf in a rectangular configuration having an upper surface and a lower surface and glued at its lower surface to the upper surface of the plywood, where the piece of turf has a length and width essentially the same as that of the plywood. Four apertures are formed in the base, plywood and turf in a rectangular configuration. Four dowels are located in the apertures to an extent upwardly for holding a football on the dowels; and an oak frame resting on the base. The frame further includes a rectangular upper section with an external periphery greater than the plywood and turf but less than the base, the frame also including four vertical posts coupled at their upper ends to the rectangular upper section at its comers and resting at its lower ends upon the turf and base.

b.) U.S. Pat. No. 4,955,485, to Alton, discloses a display device for organizing, storing and displaying a series of autographed baseballs or the like, and comprises a series of stacked shelves wherein each shelf is made up of a series of circular disc elements that reversibly engage and disengage to adjacent center shelf elements and/or end shelf elements such that the entire display device pivots about the center axis of the stack of disc elements. In this manner, a structurally stable display device that can be configured in a variety of positions and can be expanded as the number of items being displayed increase.

c.) U.S. Pat. No. 3,231,993, to Levy, is directed to an ornamental portable trophy, more particularly, to an authentic oblate-ellipsoidal football the surface of which is autographed, and an attractive stand which is functionally designed and structurally adapted to effectually present and display the football.

d.) U.S. Pat. No. 1,124,896, to Hartman, relates to a cradling device for displaying a ball, where the three legs of the device are configured like a baseball bat, and they are angled to form a tripod arrangement for cradling the ball therebetween.

Prior art unrelated to sports memorabilia, such as sports balls, are the portable and rotatable globe devices so often found in classrooms as a tool used for teaching geography and history. These devices typically mount a globe featuring the geographical areas of the earth, and are fixed within the device for rotation about the North and South Poles. Prior art which reflect such devices are found in the following U.S. Patents:

a.) U.S. Pat. No. 5,580,253, to Abdalla, teaches a geographical globe with an information base comprising an orb-shaped model assembly of the earth. A base member supports the orb-shaped model assembly. A structure in the base member supplies data about different countries on each continent of the earth.

b.) U.S. Pat. No. 4,938,695, to Kinner, relates to a device for controlling the direction of rotation of a world globe. The device has a ratchet ring which is affixed to the globe near the North or South Pole thereof. A deflectable pawl member is held by the support fame of the globe and permits the globe to rotate only so that its surface moves eastwardly.

c.) U.S. Pat. No. 3,281,961, to Tiddens, is directed to a globe structure comprising a meridian support, a world globe ball, means for rotatably carrying the globe ball on the support for rotation of the globe ball about the polar axis thereof, a base, means for rotatably mounting the support on the base, a shutter selectively movably carried on the base, a question set movable with the shutter, a plurality of answer sets on the base observable selectively as a result of the selective movement of the shutter on the base, the answer sets being registered with the question sets on the shutter, and the answer sets including answers referring to geographical designations, indicia on the base corresponding to preselected geographical positions on the world globe ball, aligning indicia means on the shutter for indicating the position of the shutter for viewing a selected one of the answer sets corresponding to a selected one of the geographical area indicia, indicia on the world globe ball corresponding to geographical designations in the answer sets, and indicia on the world globe ball corresponding to the geographical position indicia on the base.

d.) U.S. Pat. No. 2,368,347, to Colberg, relates to a geographical globe mounting means. Specifically, the invention thereof is directed to the meridian for holding the globe, where the meridian is constructed by rolling resilient flat steel wire edgewise and preferably with a curvature such that when the globe is mounted in place on the meridian, the latter exerts an inward force on the globe to secure the two in assembled relation.

While the prior art above represents diverse fields of use for static displays of sports balls, and geographic globes, where the present invention selects from features of each, they do not teach or suggest the unique combination hereof for a rotatable and releasable sports ball display. The uniqueness of this invention will become apparent in a reading of the following description, particularly when read in conjunction with the accompanying drawings.

SUMMARY OF THE INVENTION

The present invention is directed to a rotatable sports ball display mechanism for removably mounting a conventional sports ball having top and bottom portions polarly aligned with one another. The top and bottom portions are provided with hook and pile type fastening members. The mechanism comprises a base having a vertical extension mounting a C-configured bracket with upper and lower free ends. Connected to the respective free ends are a pair of aligned adjustment members, one for each bracket end, where each adjustment member includes a threaded shank for rotative movement with respect to its respective bracket end. The members further include shank end mounting a swiveling base, where the base includes a face portion in opposing relationship to the corresponding face portion on the other adjustment member. Each face portion includes a complementary hook and pile type fastening member, whereby when the adjustment members are rotatably adjusted toward one another into contact with the respective hook and pile type fastening members on the sports ball, the sports ball is temporarily held therebetween while free to rotate for easy viewing.

Accordingly, an object of this invention is to provide the collector of sports memorabilia, such as a sports ball, to rotatably display a collectable ball, while offering the collector an easy opportunity to remove and inspect the ball, then just as easily reposition the ball for display.

Another object hereof is the provision of a pair of aligned adjustable members that use hook and pile type fastening members to temporarily secure the sports ball for display.

A further object of this invention is that by the use of hook and pile type fastening members, excess pressure on the sports ball can be avoided while maintaining a sound and dynamic display.

These and other objects of the invention will become apparent to those skilled in the art from the specification which follows.

BRIEF DESCRIPTION OF DRAWINGS

FIG. 1 is a side view of the rotatable and releasable sports ball display mechanism of this invention, showing the display of a round ball, such as a basketball or soccer ball.

FIG. 2 is a partial side view of the mechanism hereof, featuring a conventional football.

FIG. 3 is an enlarged, partial side view showing details of one of a pair of adjustment members used to temporarily secure a sports ball in the display mechanism.

DETAILED DESCRIPTION OF PREFERRED EMBODIMENT

This invention relates to a rotatable and releasable sports ball display mechanism that is particularly suited for use by a sports memorabilia collector, especially one who collects sports balls. Today, on television we are inundated with sporting events where balls are prematurely retired from the game, as the balls represent some milestone in the career of a player, or a special occasion for the player, namely, a winning touchdown or final shot. Rather than placing the ball on a shelf, a unique display unit is desirable that allows one to visually display the special ball, but also gives the collector the opportunity to physically handle the ball. The present invention provides these advantages to the sports ball collector. Such invention will now be described in detail in the accompanying Figures and specification to follow, where like reference numerals represent like components or features throughout the several views.

FIG. 1 illustrates the sports ball display mechanism 10 of this invention. The mechanism 10 comprises a pedestal base 12, for resting on a horizontal surface, having a vertically extending member 14 mounting a C-configured bracket 16, where the respective free ends 18, 20 are preferably offset from the vertical. As best seen in FIGS. 1 and 2, the opening of the bracket 16 is of a size to freely receive a conventional sports ball such as a basketball "B" or football "F", and covers an arcuate length at least slightly greater than 180 degrees.

Mounted at the respective free ends 18, 20 are a pair of aligned adjustment members 22, where such members are approximately 180 degrees apart about the bracket 16. Further, the bracket 16 is of a sufficient lateral thickness to accommodate a through bore 24 for receiving the adjustment member 22.

As best seen in FIG. 3, the adjustment member 22 comprises a threaded shaft 26, with a manual rotation head 28 at one end thereof. The opposite end of the threaded shaft 26 is a balled end 30 (shown in dotted lines) for engagement with a freely rotatable head member 32 featuring a face portion 34. That is, while the head member 32 is spatially set relative to the shaft 26, it is free to rotate thereabout.

The threaded shaft 26 is fixed for movement relative to the bracket 16 by at least one complementary threaded nut 36 secured to the wall of bracket 16. As the respective manual rotation heads 28 are turned clockwise, for example, the threaded shafts 26, and hence the head members 32, move axially toward one another to engage a sports ball. To facilitate engagement with a sports ball "B" or "F", the respective face portions 34 are provided with hook and pile type fastening members 38, known commercially as VELCRO, a trademark, for fabric fastening strips. Complementary hook and pile type fastening members 40 are positioned at opposite end portions of the sports ball. Such end portions may be readily ascertained on a ball by the seams, shape, or logos, as known in the art.

Since the primary sports balls to which this invention relates are inflatable balls, it is rather obvious that the respective adjustment members 22 may be mutually adjusted to actually compress the ball therebetween. Under such situation it may be difficult to freely rotate the ball. However, it was discovered that by the use of hook and pile type fastening members 38, 40, only a limited pressure is required. That is, hook and pile type fastening members eliminate the need for excess pressure to hold the ball "B", "F". Thus, free rotation with ball retention was made possible by the unique fastening arrangement.

While the invention has been described with reference to a preferred embodiment, it is clear that changes, modifications, and variations may be made to the display mechanism hereof, particularly by those skilled in the art. Accordingly, no limitation is intended to be imposed on this invention except as set forth in the following claims.

I claim:

1. A rotatable sports ball display mechanism for removably mounting a conventional sports ball having top and bottom portions polarly aligned with one another, where said top and bottom portions are provided with hook and pile type fastening members, said mechanism comprising:

a.) a base having a vertical extension mounting a C-configured bracket with the free ends thereof defined as upper and lower ends; and b.) a pair of aligned adjustment members, one for each said bracket end, each said adjustment member comprising a threaded shank for rotative movement with respect to its respective bracket end, and a free shank end mounting a swiveling base, said base including a face portion in opposing relationship to the corresponding face portion on the other adjustment member, where each said face portion includes a complementary hook and pile type fastening member, whereby when said adjustment members are rotatably adjusted toward one another into contact with the respective hook and pile type fastening members on said sports ball, said sports ball is temporarily held therebetween while free to rotate for easy viewing.

2. The rotatable sports ball display mechanism according to claim 1, wherein said C-configured bracket has an arcuate dimension of at least 180 degrees.

3. the rotatable sports ball display mechanism according to claim 2, wherein said upper and lower ends define a line offset from the vertical.

4. The rotatable sports ball display mechanism according to claim 1, wherein said swiveling base is spatially fixed to said threaded shank, yet free to rotate relative thereto.

5. The rotatable sports ball display mechanism according to claim 1, wherein said C-configured bracket at said upper and lower ends includes at least a pair of fixed threaded members for receiving said threaded shanks.

6. The rotatable sports ball display mechanism according to claim 1, including manual means for selectively rotating said adjustment members.

* * * * *